US005448500A

United States Patent [19]

Bredy et al.

[11] Patent Number: 5,448,500

[45] Date of Patent: Sep. 5, 1995

[54] MUNITION COMPRISING TARGET DETECTION MEANS

[75] Inventors: Thierry Bredy, Asnieres les Bourges; Emmanuel Marchand, Bourges; Philippe Martin, Bourges; Christophe Redaud, Bourges, all of France

[73] Assignee: Giat Industries, Versailles, France

[21] Appl. No.: 85,052

[22] Filed: Jul. 2, 1993

[30] Foreign Application Priority Data

Jul. 2, 1992 [FR] France ..... 92 08141

[51] Int. Cl.[6] ..... G06F 17/00

[52] U.S. Cl. ..... 364/516; 102/384

[58] Field of Search ..... 364/516, 517, 423; 235/401, 407; 356/3, 9; 102/384, 387

[56] References Cited

U.S. PATENT DOCUMENTS

| | | | |
|---|---|---|---|
| 2,187,825 | 9/1939 | De Jessey et al. | 102/387 |
| 2,427,463 | 9/1947 | Klemperer et al. | 364/423 |
| 4,057,708 | 11/1977 | Greeley et al. | 364/423 |
| 4,568,040 | 2/1986 | Metz | 102/384 |
| 4,878,433 | 11/1989 | Pirolli | 102/387 |
| 5,076,511 | 12/1991 | Stein et al. | 102/384 |
| 5,280,752 | 1/1994 | Borgstrom et al. | 102/384 |
| 5,341,743 | 8/1994 | Redaud | 102/384 |

FOREIGN PATENT DOCUMENTS

| | | |
|---|---|---|
| 592890 | 11/1977 | Switzerland . |
| 2090950 | 7/1982 | United Kingdom . |
| 2226466 | 6/1990 | United Kingdom . |

*Primary Examiner*—Ellis B. Ramirez
*Attorney, Agent, or Firm*—Oliff & Berridge

[57] ABSTRACT

A munition including a submunition has a target detector and a core-generating charge with a firing axis Δ for firing a projectile. The munition is designed to move relative to the ground and seek a target. The munition rotates about an axis A with a velocity translation $v_0$. The target detector includes several detection axes $\delta_1$ through $\delta_n$ and a device for selecting a detection axis $\delta_i$ from the detection axes $\delta_1$–$\delta_n$ for which the distance E between the point $M_i$ at which the axis $\delta_i$ intersects the ground and the point M′ at which the projectile strikes the ground is minimal.

10 Claims, 9 Drawing Sheets

MUNITION COMPRISING TARGET DETECTION MEANS

BACKGROUND OF THE INVENTION

The present invention relates to a munition, particularly a submunition comprising target detection means.

Delivery systems are known to comprise an active homing head associated with means for orienting a detection axis in an elevation direction and a relative bearing direction with respect to the delivery systems. These delivery systems, typically missiles, generally include self-tracking means that guide the missiles to the target. This type of delivery system is extremely expensive to manufacture.

Great Britain Patent 2,090,950 describes a submunition with a complex movement and comprising a core-generating charge and target detection means. The orientation of the target detection means is fixed relative to the submunition, with the target detection axis being parallel to the firing axis of the core. As will be explained below, the complex movement of the submunition ensures that a substantial area of the ground is scanned by the target detection means. When a target is detected, firing is triggered. If the target detection axis is parallel to the firing axis, and these two axes are close, the core is sent substantially in the direction of the target.

However, there is a problem with the lag between the moment of detection and the moment of firing, due principally to both processing tie and to the velocity of the submunition at the time of firing necessary to achieve the complex trajectory ensuring scanning, introducing firing inaccuracy that can be as high as or greater than 10 meters. This error cannot be equated with a fixed bias that could be fully corrected by shifting the detection axis by a fixed amount relative to the firing axis. The residual error is sufficient to considerably cut down the probability of reaching the target.

A possible solution is to use a target detection means with a detection axis capable of being oriented in the direction of the target. Although technically feasible, this solution is too expensive to be adapted to this type of submunition.

SUMMARY OF THE INVENTION

Hence, a goal of the present invention is to provide a munition and a submunition with a high probability of reaching a target.

It is also a goal of the present invention to provide a munition or a submunition at moderate cost.

It is also a goal of the present invention to provide a munition or submunition whose core-generating charge is not triggered when a target is detected if the probability of reaching this target proves to be less than a preset threshold.

These goals are achieved by a munition or submunition comprising target detection means with a plurality of target detection axes that are not parallel and means for selecting the target detection axis which, at time t, affords the greatest probability of attaining the target detected at this time t.

Another goal of the invention is a munition, particularly a submunition, comprising a charge firing a projectile, particularly a core-generating charge with a firing axis Δ and target detection means, which munition is designed to move relative to the ground allowing it to seek a target. This movement comprises a rotation about an axis A and an instant velocity translation $v_0$. The munition has a target detection means comprising several selectable detection axes δ1 through δn and comprising means allowing selection, at each detection instant, of a detection axis δi for which the distance E between a point Mi at which axis 6i intersects the ground and a point M' at which the projectile strikes the ground is minimal.

The invention also has as an object a munition characterized by detection axes δ1 through δn of the target detection means being fixed relative to the firing axis Δ.

The invention also has as an object a munition having means allowing the detection axis δi, for which distance E is minimal, to be selected. This means for allowing selection of the detection comprise measuring means allowing a determination to be made at any instant as to which axis δi has the forwardmost orientation of the munition in the direction given by velocity $v_0$ of the center of gravity of the munition.

The invention also has as an object a munition able to rotate about an axis of rotation A inclined relative to vertical, wherein the measuring means comprises a rangefinder able to measure the distance from the munition to the ground.

The invention also has as an object a munition characterized by the measuring means comprising a gyroscope or a gyrometer allowing its angular position relative to velocity vector $v_0$ to be measured.

The invention also has as its object a munition characterized by the fact that the means allowing the detection axis δi for which distance E is minimal to be selected are associated with means such as a gyroscope or gyrometer allowing its angular position to be measured relative to velocity vector $v_0$ of the center of gravity of the munition with means for measuring the distance to the ground and/or measuring the instant velocity $v_0$.

The invention also has as an object a munition characterized by the fact that the detection means comprise a single sensor including a plurality of detectors, in particular an array of detectors.

The invention also has as an object a munition characterized by detection axes δ1 through δn being regularly distributed at its periphery and outwardly inclined at the same angle relative to axis Δ.

The invention also has as an object a munition characterized by the target detection means comprising a single detector associated with a plurality of optical systems having nonparallel axes.

The invention also has as an object a munition comprising a blanking cap allowing the detector to be illuminated at each instant t by the radiation transmitted by a single optical system with axis δi.

BRIEF DESCRIPTION OF THE DRAWINGS

The invention will be better understood by means of the description hereinbelow and attached figures provided as nonlimiting examples wherein:

In FIGS. 1 to 16, the same reference numerals are used to designate the same elements.

DETAILED DESCRIPTION OF PREFERRED EMBODIMENTS

Figure 1:
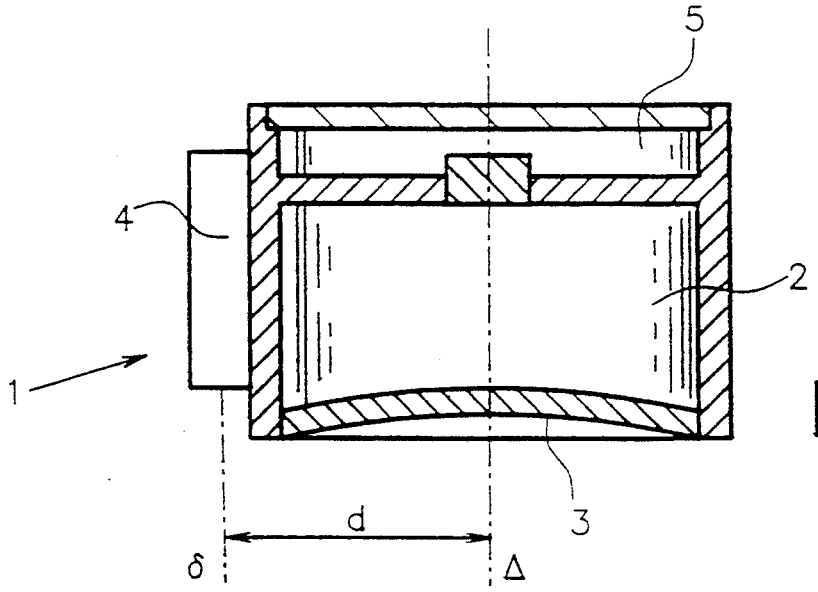
FIG. 1 is a cross section of a submunition of a known type.
Figure 2:
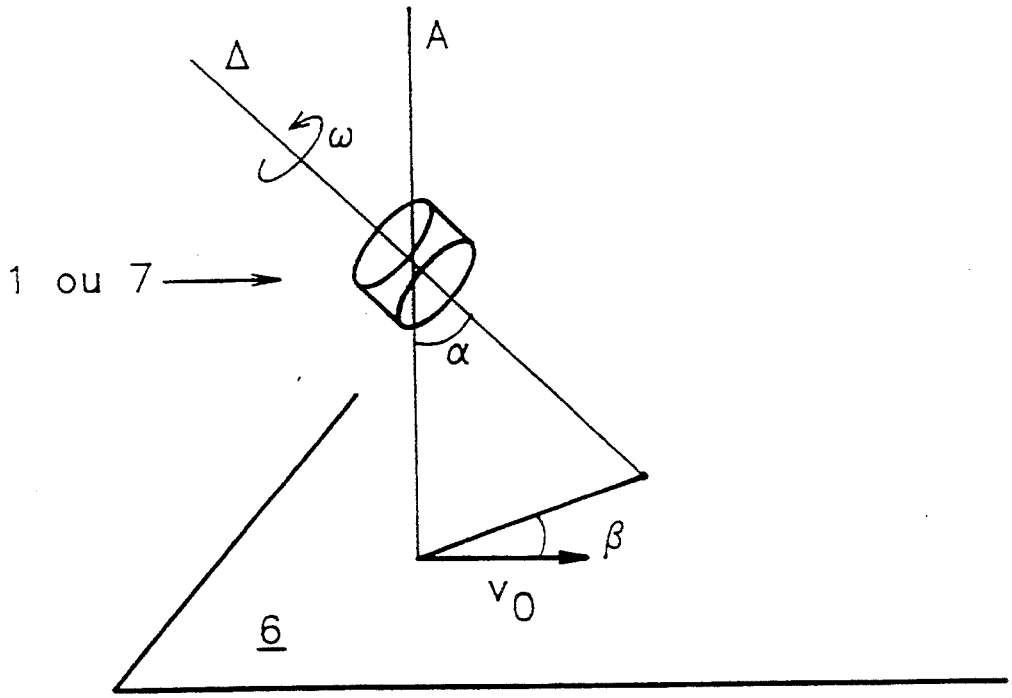
FIG. 2 is a explanatory diagram.

FIG. 1 shows a submunition 1 of a known type comprising a core-generating charge 2 including an explosive charge and a cover 3 forming the core, target detection means 4 with an axis $\delta$, and a chamber 5 containing electronic equipment (not shown). An axis $\Delta$ of submunition 1 (along which axis the core is fired) is shown in FIG. 1 as being vertical although at an instant t it has a non-zero angle e with $\alpha$ vertical axis of rotation A of the submunition as illustrated in FIG. 2.

$\beta$ is the angle at an instant t between the projection onto ground 6 (assumed to be a plane) and velocity $v_0$ of the center of gravity of the submunition and the projection onto the ground of axis $\Delta$. Axes $\delta$ and $\Delta$ are separated by a short distance d, essentially equal to half the diameter of the submunition.

Figure 3:
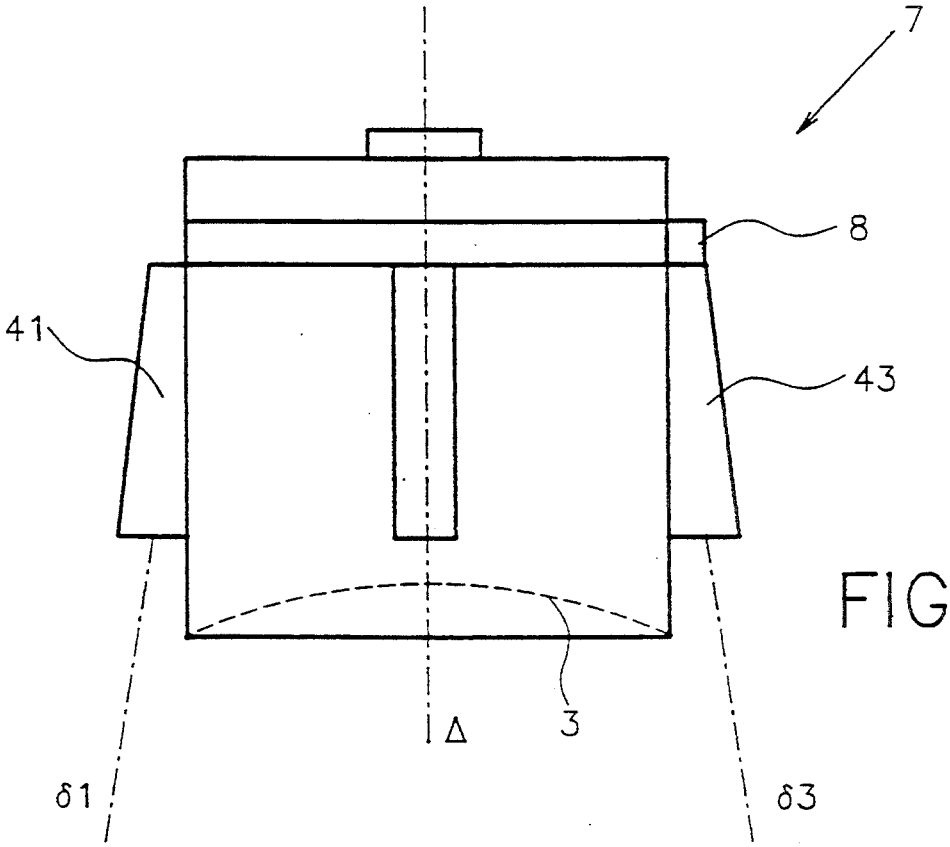
FIG. 3 is a side view of a first embodiment of a submunition according to the present invention.
Figure 4:
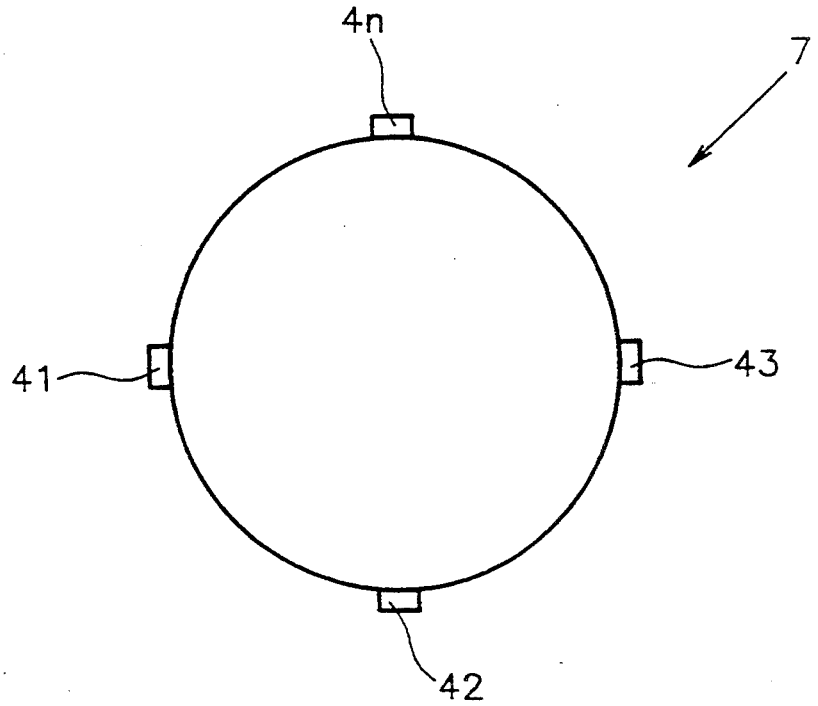
FIG. 4 is a schematic top view of the submunition of FIG. 3.

FIGS. 3 and 4 show the preferred embodiment of a munition 7 according to the present invention. The target detection means of munition 7 according to the invention comprise a plurality of selectable target detection means $4_1$, $4_2$, $4_3$, . . . , 4n having nonparallel detection axes $\delta_2$, $\delta_3$, . . . , $\delta_n$, for example outwardly inclined at the same angle relative to axis $\Delta$. The target measuring means comprise position-measuring means 8 to determine at every instant which axis $\delta_i$ has the forwardmost orientation of the submunition in the direction given by velocity $v_0$. The position measuring means comprise, for example, a gyroscope or a rangefinder.

In another further-improved embodiment, position-measuring means 8 of munition 7 comprise an inertial reference sensor and/or a rangefinder or an altimeter.

In one embodiment, munition 7 is equipped with only one target detector associated with means for orienting the detection axis in predetermined nonparallel directions relative to the submunition. The detector is associated with a plurality of sighting means, for example a plurality of lenses with nonparallel optical axes and switching means to select a lens, for example a controlled blanking cap having a single aperture.

Figure 13:
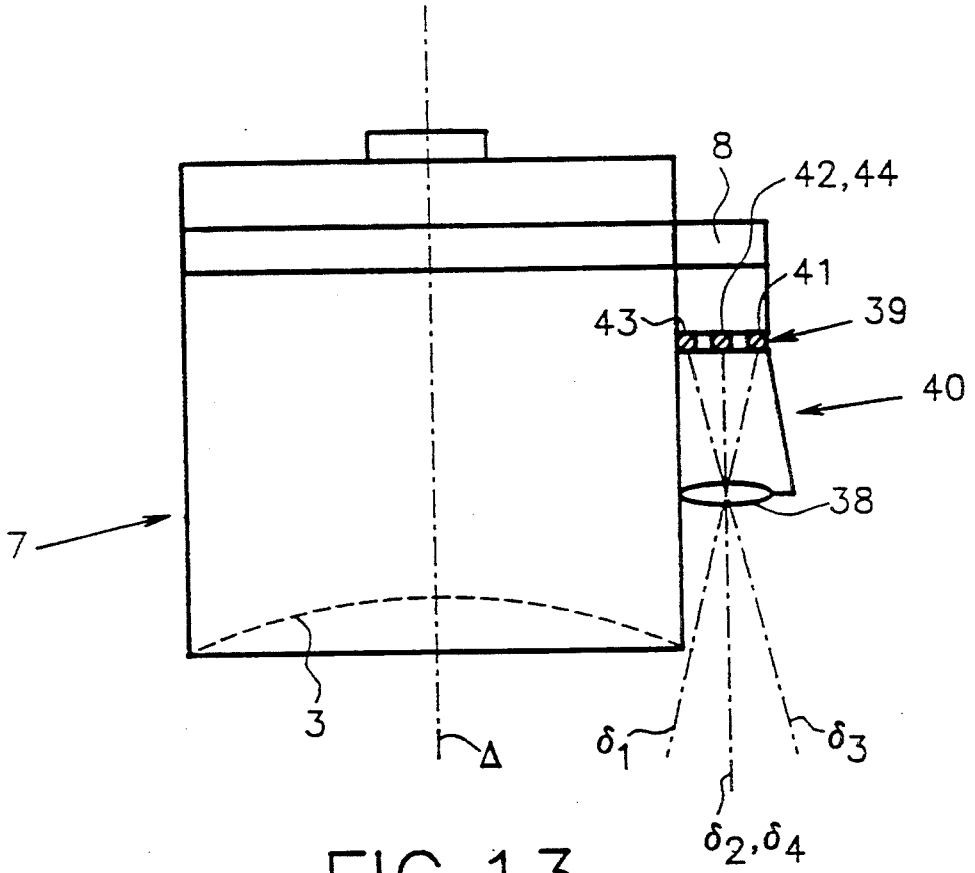
FIG. 13 is a side view of a third embodiment of a submunition according to the present invention.
Figure 14:
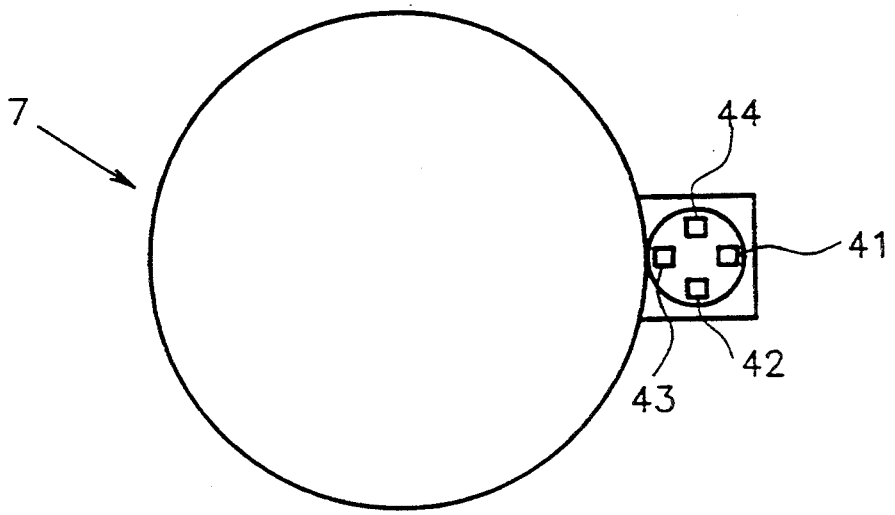
FIG. 14 is a schematic view from below of the submunition of FIG. 13.
Figure 15:
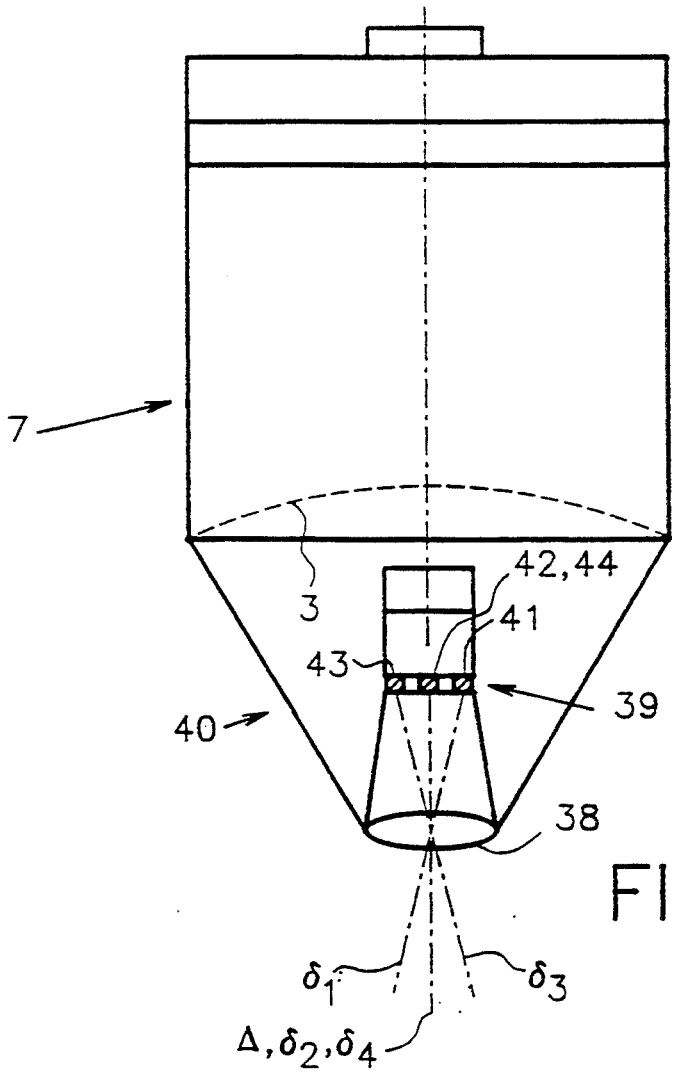
FIG. 15 is a side view of a fourth embodiment of a submunition according to the present invention.

In another embodiment, the submunition has detection means comprising an array of detectors associated with a single optical system. These detection means are disposed along a generatrix of the envelope of the submunition as illustrated in FIGS. 13 and 14 or in the extension of axis $\Delta$, as shown in FIG. 15.

Figure 5:
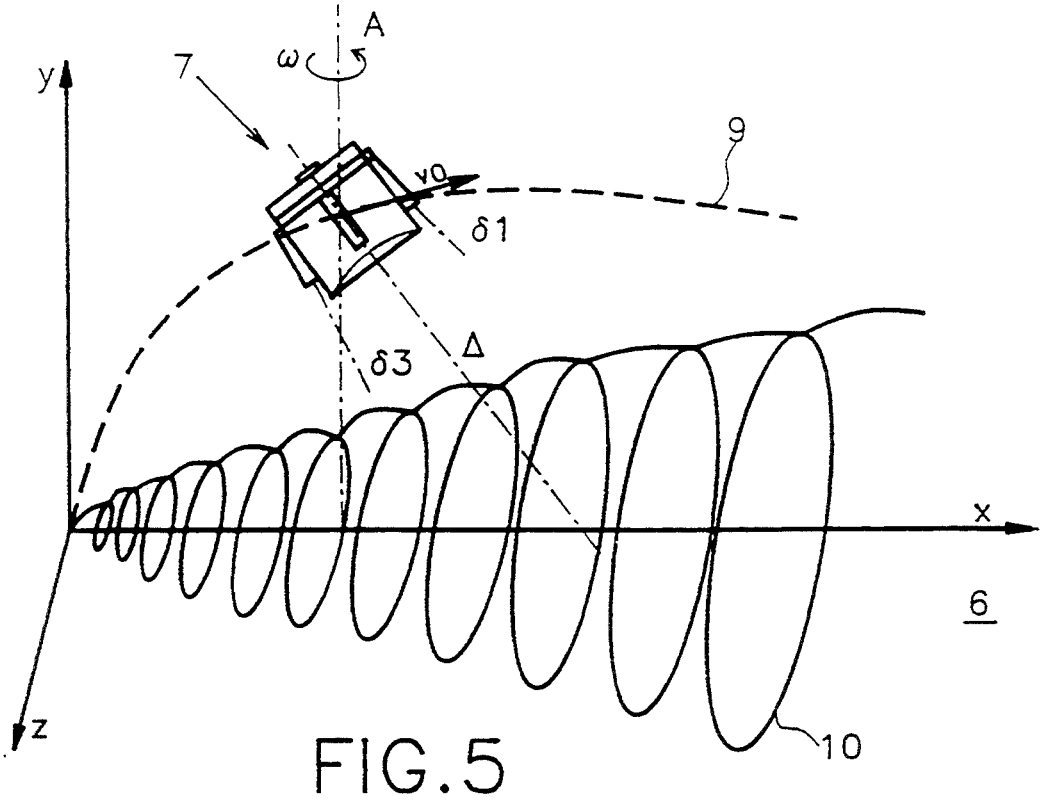
FIG. 5 is a schematic perspective view illustrating the scanning effected by the submunition according to the present invention.

FIG. 5 shows a submunition 7 according to the invention rotating about axis A with an angular velocity $\omega$ whose center of gravity follows a ballistic trajectory 9 in a system of axes (x, y, z). The track of axis $\Delta$ on the ground 6, symbolized by plane (x, z) is shown by numeral 10. As can be seen in FIG. 5, track 10 corresponds to a large area of ground 6 ensuring scanning of a large surface area for target detection.

With each revolution, distance E between the point of impact on ground 6 of the core generated by cover 3 (for a firing triggered at a target detection instant t by a target detection means $4_i$ having a detection axis $\delta_i$) and the intersection of axis $\Delta$ with ground 6, varies and depends on the orientation of axis $\delta_i$ relative to axis $\Delta$. This distance corresponds to the firing error. If distance E is too long, core 3 misses the target. Since distance E depends on the orientation of detection axis $\delta_i$ according to the invention, at each instant a selection is made among target detection means $4_1$ through $4_n$ of the means $4_i$ whose target detection axis $\delta_i$ corresponds to a minimal distance E between intersection $M_i$ of ground 6 with axis $\delta_i$ and point of impact M' of the core on ground 6. Advantageously, target detection axes $\delta 1$ through $\delta n$ are disposed relative to axis of rotation A of the submunition such that in the course of each revolution, each of axes $\delta_i$ of the target detection means, at a given instant of the revolution, corresponds to a minimal distance E.

Figure 6:
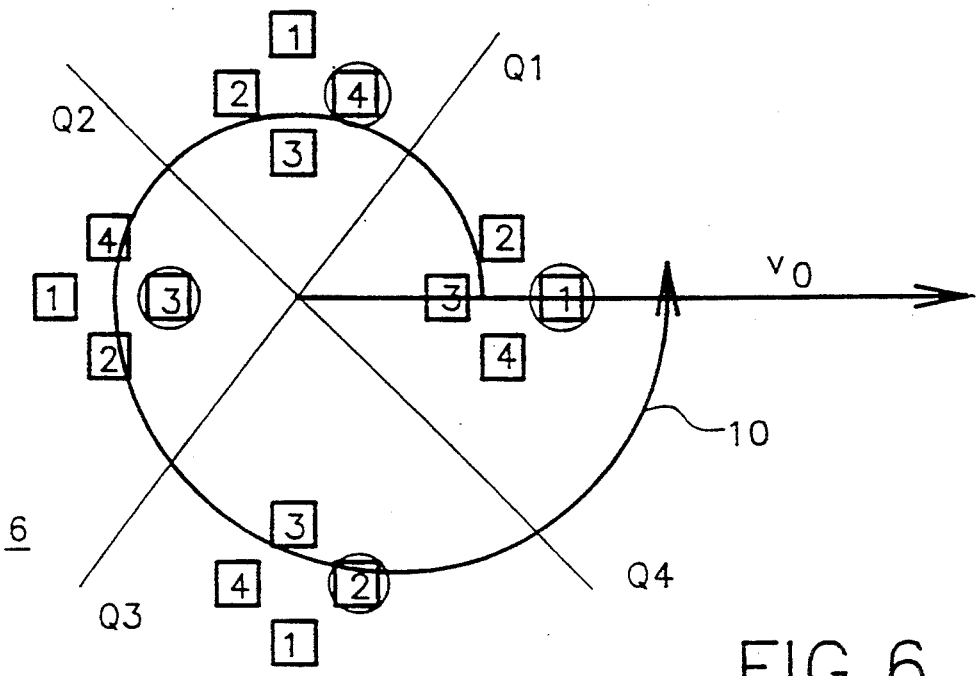
FIG. 6 is an explanatory diagram.

FIG. 6 shows four successive positions of the orientation of the four axes $\delta 1$ through $\delta 4$ in the course of one revolution of submunition 7 of FIGS. 2 and 3 for which axes $\delta_1$ through $\delta_4$ are inclined toward the outside of the submunition by the same angle relative to axis $\Delta$. Numerals 1 through 4 are placed in rectangles corresponding to the orientation of axes $\delta_1$ through $\delta_4$, respectively. The circled rectangles correspond to axis $\delta_i$ which gives a minimal distance E for each of the four successive positions of the submunition.

According to a first embodiment of the invention, it may be considered that at each instant the axis $\delta_i$ which corresponds to a minimal distance E is the axis which, of all the detection axes, has the closest orientation to that of velocity vector $v_0$ of the center of gravity of submunition 7. In the example illustrated with four axes $\delta_1$ through $\delta_4$, ground 6 may, at any instant, be divided into four quadrants delimited by four half-lines whose origin corresponds to the point of intersection of vertical axis A with ground 6 and which are oriented at angles:

Q1=45°, Q2=135°, Q3=225°, and Q4=315°.

Figure 7:
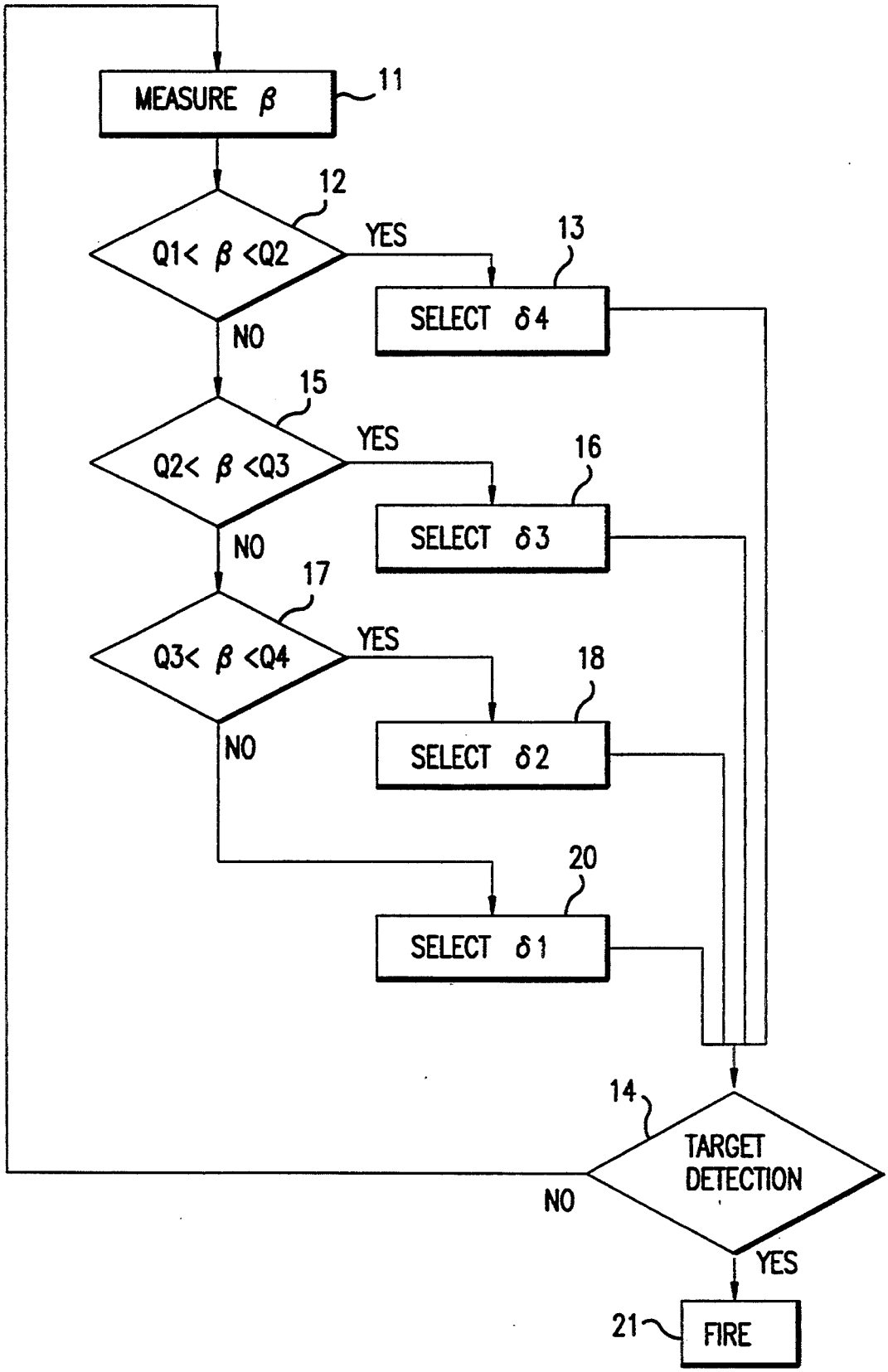
FIG. 7 is a flowchart of a first embodiment of the device according to the present invention.

FIG. 7 shows a flowchart of one operating mode of a submunition according to the present invention. Beginning at step 11, angle $\beta$ between velocity vector $v_0$ of the center of gravity of submunition 7 and the projection on ground 6 of axis $\Delta$ of munition 7 is measured. Then angle $\beta$ is checked to determine whether angle $\beta$ is between Q1 and Q2, step 12. If angle $\beta$ is between Q1 and Q2, axis $\delta_4$ is selected, step 13. If angle $\beta$ is not between Q1 and Q2, angle $\beta$ is checked to determine if it is between Q2 and Q3, step 15. If angle $\beta$ is between Q2 and Q3, axis $\delta_3$ is selected step 16. Then, it is checked whether a target has been detected, step 14. If angle $\beta$ is not between Q2 and Q3, angle $\beta$ is checked to determine if it is between Q3 and Q4, step 17. If angle $\beta$ is between Q3 and Q4, is between Q3 and Q4, axis $\delta_2$ is selected, step 18. Then, it is checked whether a target has been detected, step 14. If angle $\beta$ is not between Q3 and Q4, axis $\delta_1$ is selected, step 20. Then, it is checked whether a target has been detected, step 14. If no target is detected, return to step 11. If a target is detected, firing is triggered, step 21.

Figure 8:
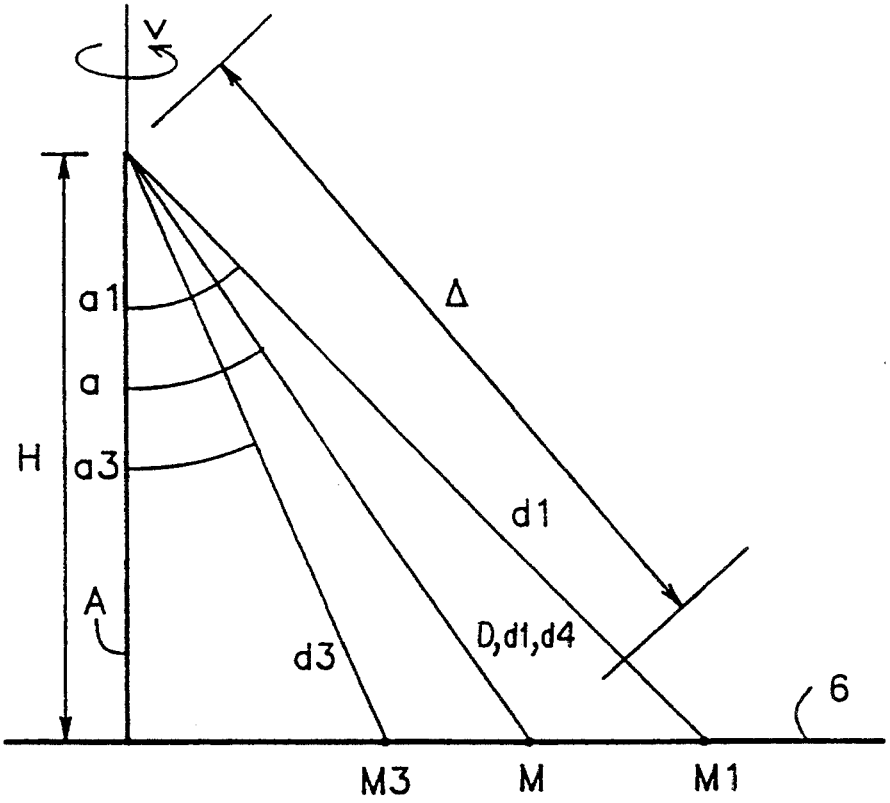
FIG. 8 is a diagram explaining the operation of the device according to the present invention.

FIG. 8 shows the orientation of the detection axes projected on a plane defined by axis of rotation A of the submunition and by axis $\Delta$. Axes $\delta_3$, $\Delta$, and $\delta_1$ form angles $\alpha_3$, $\alpha$, and $\alpha_1$, respectively, with axis A. H represents the altitude of munition 7 and D the distance between the munition and intersection M of axis $\Delta$ with ground 6.

Figure 9:
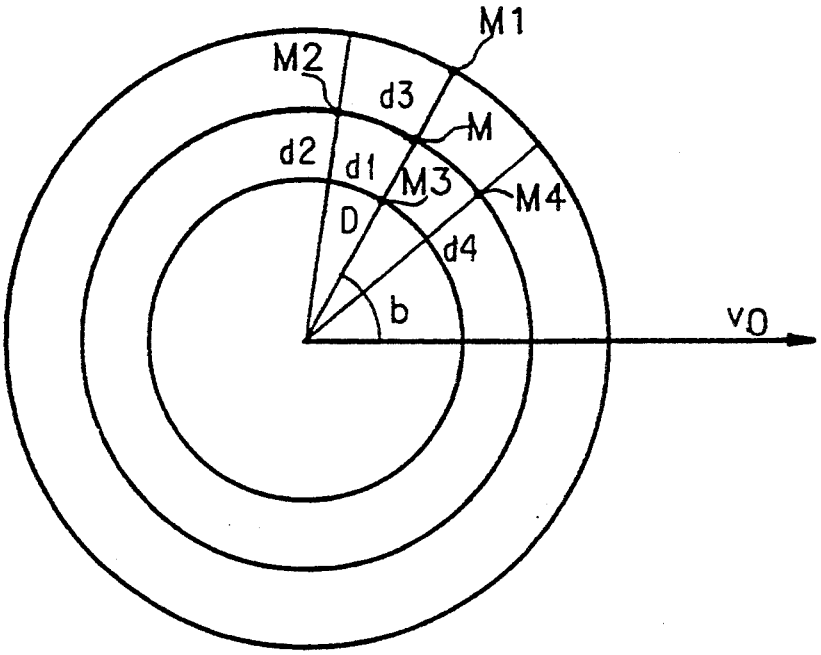
FIG. 9 is a diagram explaining the operation of the device according to the present invention.

FIG. 9 shows the points of intersection M, $M_1$, $M_2$, $M_3$, and $M_4$ of axes $\Delta$, $\delta_1$, $\delta_2$, $\delta_3$, and $\delta_4$, respectively, with ground 6.

Of course the invention is not limited to the arrangement of axes $\delta_1$ through $\delta_4$ in FIGS. 2 and 3, but applies in general to the choice at each instant t of a detection axis, advantageously preset, which at a particular instant minimizes the distance E between the point of impact of the core and the position of the target (assumed to be motionless). Likewise, it is possible to inhibit detection during time intervals in which no detection axis offers a sufficient probability of reaching the target if firing is triggered. In such a case, the submunition continues its trajectory with a non-zero probability of detecting a second target and destroying it. Advantageously, when the submunition is manufactured according to the present invention, the detection axes are oriented such as to obtain a large scanning area on the ground bearing in mind the switches between the various detection axes used at various times during the ballistic trajectory of the submunition.

FIGS. 13, 14, and 15 show two examples of a submunition according to the invention whose detection means comprise a single sensor 40 comprising an optical system 38 illuminating a plurality of detectors $\mathbf{4}_1$ to $\mathbf{4}_n$. In the examples illustrated, n=4, but it is understood that a higher number n advantageously affording greater accuracy will not be a departure from the present invention. Detectors $\mathbf{4}_1$ through $\mathbf{4}_n$, for example infrared detectors able to detect the thermal radiation of a target, are advantageously distributed on a single PC board 39. Sighting axes $\delta_1$ corresponding to the various detectors $\mathbf{4}_i$ are not parallel. The angle between an axis $\delta_i$ and axis $\Delta$ depends on the distance between detector $\mathbf{4}_i$ and the intersection of an axis of optical system 38 with PC board 39. In the example illustrated in FIGS. 13 and 14, sensor 40 is disposed on the envelope of the submunition, while in the example illustrated in FIG. 15, it is disposed in front of cover 3 which is to form the core. Advantageously, in the latter case, the axis of optical system 38 is the same as axis $\Delta$. The devices in FIGS. 13 to 15 allow selection of the detector $\mathbf{4}_i$ whose axis $\delta_i$ has the forwardmost orientation (direction of $v_0$) of the submunition. Detector $\mathbf{4}_i$ can be selected by electronic control means which may or may not be incorporated into board 39, with detectors $\mathbf{4}_1$ through $\mathbf{4}_n$ being illuminated simultaneously.

Figure 10:
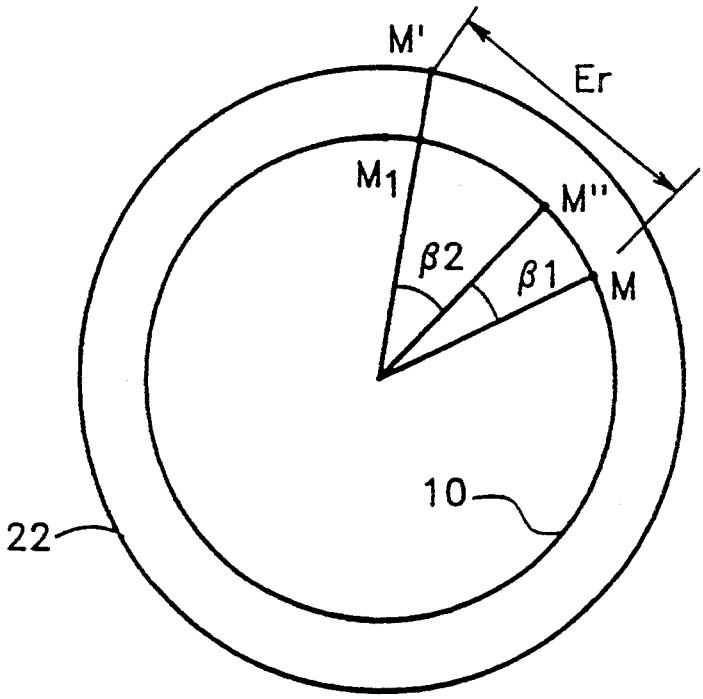
FIG. 10 is a diagram explaining the disadvantages of devices of known type.

FIG. 10 shows an approximation of the contribution Er made to total error E by rotation of munition 7 around axis A with an angular velocity $\omega$ and for a given detection axis $\delta i$. If, in calculating this contribution error Er, velocity $v_0$ of the center of gravity of the submunition is not taken into account, the track 10 of axis $\Delta$ and track 22 of axis $\delta_i$ are represented by circles. The target at point M is detected at time $t_0$ and firing is triggered at time $t_1$, where $t_1-t_0$ corresponds to the processing time. Let r be the distance between the center of gravity of the cover of the core-generating charge and axis of rotation A. Angle $\beta 1$ is equal to $\omega(t_1-t_0)$ and corresponds to the rotation of submunition 7 which causes a point M" of circle 10 to correspond with point M. Angle $\beta 2$, equal to arctan $(r\omega/V)$, V being the velocity (assumed constant) of the core after firing, corresponds to the shift induced by the velocity of entrainment $(r\omega)$ of the submunition in the velocity of the core and causes a point M' of circle 22 to correspond to point M" of circle 10. $\beta=\beta 1+\beta 2$.

In the first approximation, one can write:

$$\begin{aligned} Er &= MM' \\ &= MM'' + M''M' \\ &= \omega \cdot ((t_1 - t_0)\tan(\alpha) + r/V) \cdot \cos(\alpha)) \end{aligned}$$

($\alpha$ being the angle between $\Delta$ and $A$)

It should be noted that the angular error $(\beta 1+\beta 2)$ is constant over time and always in the same direction. Thus, the point of impact is always ahead of the point detected, in the direction of rotation. Thus, with a fixed shift of detection axis $\delta i$ relative to axis $\Delta$ of the submunition with an angle $(\beta 1+\beta 2)$ in the plane of ground 6, one can reduce the distance Er to M1M', M1 being the point of circle 10 shifted relative to M by an angle $(\beta 1+\beta 2)$. To correct the error between M1 and M' requires an additional shift of the detection axis, this time in the plane containing axis A and axis $\Delta$, with this shift having to be variable, particularly with altitude H. Such a device would require a controlled detection axis, which is very expensive.

Figure 11:
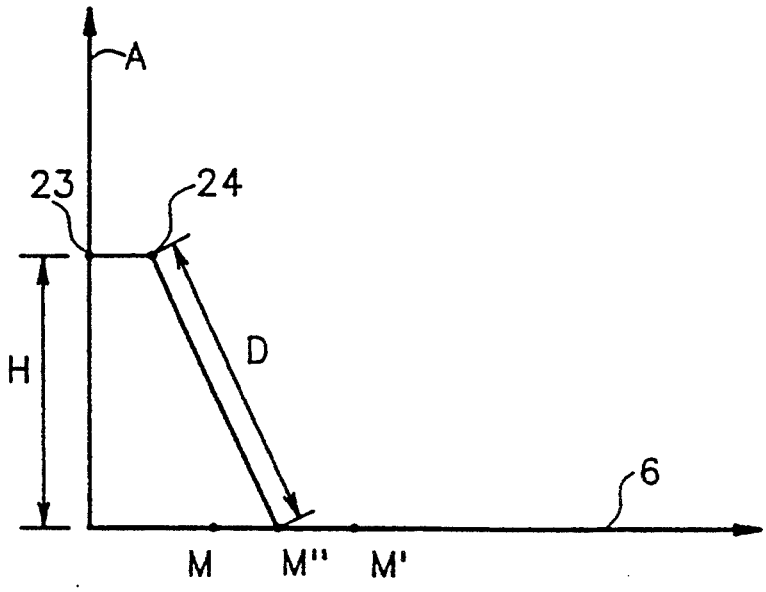
FIG. 11 is a diagram explaining the disadvantages of devices of known type.

FIG. 11 shows an approximation of the contribution Ev made to total error E by velocity $v_0$ of the center of gravity of submunition 1 to error E.

In FIG. 11, the center of gravity of submunition 7 has reference numeral 23 at the time the target is detected and reference numeral 24 at the time of firing. Error Ev is due both to lag $t_1-t_0$ between detection and firing (distance between points 23 and 24) and to the entrainment velocity $v_0$ imparted to core 3 at the time of firing.

In the first approximation, one can write:

$$\begin{aligned} Ev &= MM' \\ &= MM'' + M''M' \\ &= v_0(t_1 - t_0) + DV_0/V \end{aligned}$$

The error depends on the distance D between the center of gravity of the submunition and the intersection of axis $\Delta$ with ground 6. This distance depends on altitude H of submunition 1 as well as angle $\alpha$ at the time of firing. The following values were obtained for one example of firing:

$v_0=50$ m/s
H=100 m
V=2000 m/s
$t_1-t_0=0.5\ 10^{-3}$s
$\alpha=30°$
E=2.91 m.

If one endeavors to correct error E by a constant shift of axis $\beta$ relative to axis $\Delta$ (of 1.2° in the above example), one finds that, while the detected error is indeed zero when the detector is forwardmost relative to the submunition in the direction of travel indicated by $v_0$, the error is on the contrary amplified (equal to 5.8 m in the above example) when the detector is located rearmost relative to the submunition in the direction of travel indicated by $v_0$.

The embodiments described above use a gyroscope or a gyrometer to determine which axis $\delta_i$ has the forwardmost orientation of the submunition in the direction given by velocity $v_0$. In the case where axis of rotation A is not vertical, it is possible to replace the gyroscope or gyrometer with a rangefinder disposed such as to measure the distance of the munition from the ground along axis A or along a generatrix of the envelope of the munition.

Figure 16:
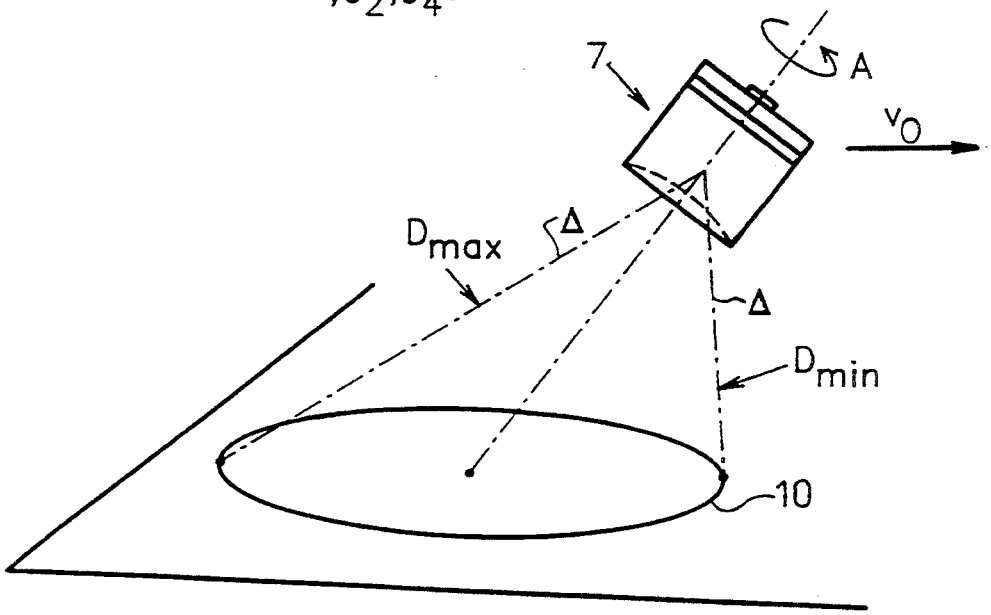
FIG. 16 is a diagram explaining the operation of a fifth embodiment of a submunition according to the present invention.

When axis A is not vertical, this distance from the ground varies as a function of the angular position of the submunition. FIG. 16 shows such a submunition schematically as well as the track 10 of axis $\Delta$ on ground 6. It will be noted that, when the submunition rotates, the distance D to the ground along axis $\Delta$ varies between a value Dmax and a value Dmin. Since the position of the detection means relative to the axis of the rangefinder is fixed, and the orientation of axis A relative to the ground is essentially constant, the output signal from the rangefinder could be used directly to determine at any instant which axis $\delta_i$ has the forwardmost orientation of the munition in the direction given by the velocity $v_0$.

In a particularly efficient variation of the device according to the present invention, means 8 for measuring the position of submunition 7 comprise an inertial reference sensor and/or a rangefinder allowing distance D to be measured, as well as the distance between the center of gravity of submunition 7 and point M'. For example, velocity $v_0$, rotational speed $\omega$, and altitude H are measured.

Figure 12:
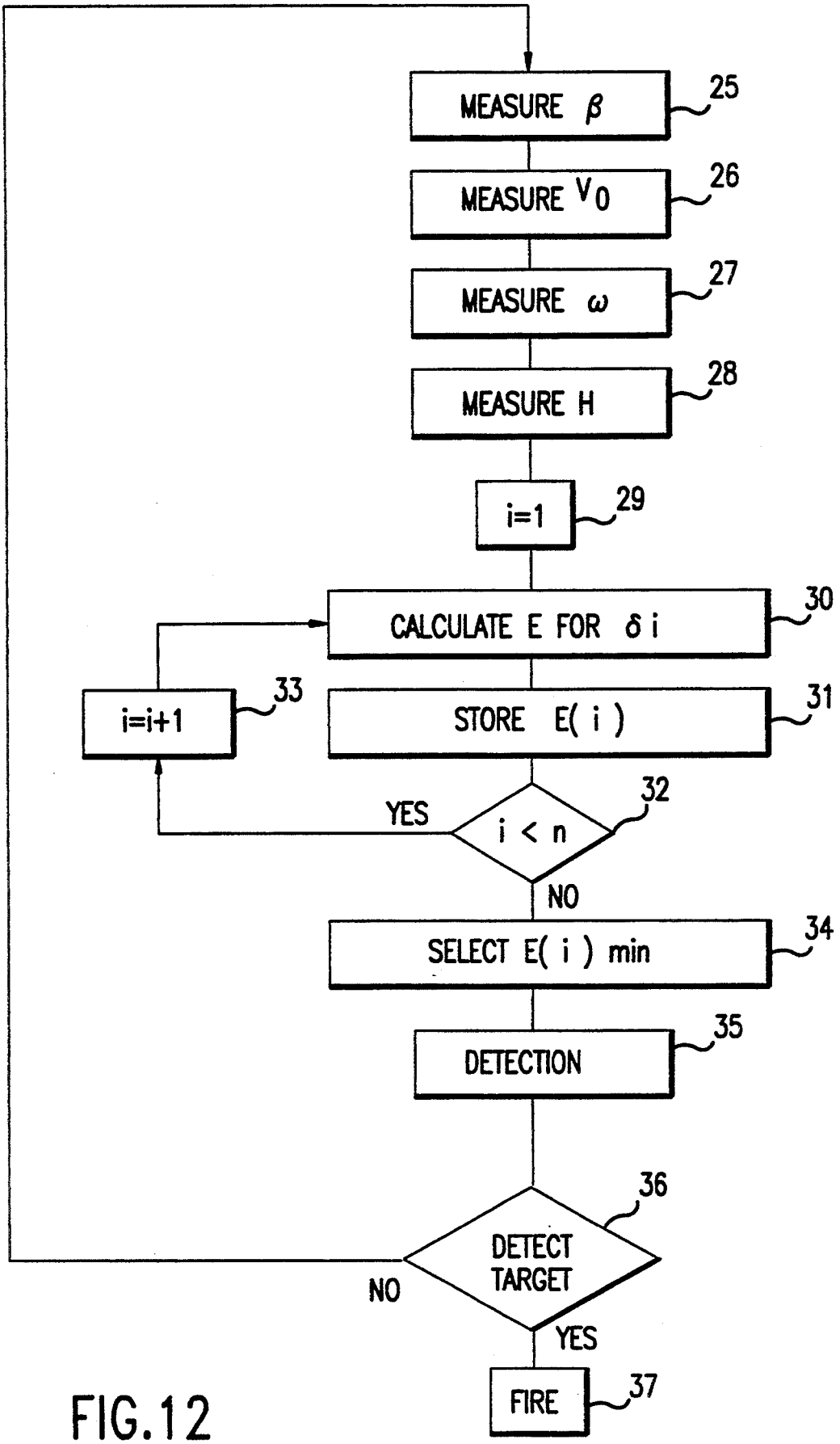
FIG. 12 is a flowchart illustrating the operation of a second embodiment of the device according to the present invention.

FIG. 12 shows a flowchart illustrating the operation of this improved embodiment of submunition 7. Beginning with step 25, angle $\beta$ is measured. Then the velocity $v_0$ of the center of gravity of submunition 7 is measured, step 26 and the rotational speed of submunition 7 is measured, step 27. Then, the altitude H of submunition 7 is measured, step 28. Then, the counter of the various available detection axes $\delta_i$ is initialized, step 20. Following this, the error E for a sighting axis $\delta_i$ is calculated, step 30. Then, the value of error E and the reference of associated detection axis $\delta_i$ are stored in memory. Then, it is determined if any detection axes $\delta_i$ for which error E has not been calculated remain, step 32. If there are detection axes of which E has been calculated, the reference counter of detection axes $\delta_i$ is incremented, step 33 and E is calculated at step 30. If values of E for all of the detector axes are calculated, the axis $\delta_i$ corresponding to the minimum error $E_i$ is selected, step 34. Then, a target is detected, step 35. Then it is determined if a target has been detected, step 36. If a target is detected firing is triggered, step 37. If not, return to step 25.

The invention has been described above in detail with reference to its preferred embodiments, which are intended to be illustrative and non-limiting. Various changes and modifications may be made without departing from the spirit and scope of the invention as defined in the following claims.

What is claimed is:

1. A munition having a target detection system that operates when said munition moves relative to the ground to seek a target, said munition comprising:

a submunition;

a core-generating charge for firing a projectile, said core-generating charge have a firing axis $\Delta$;

a target detector comprising a plurality of detection axes $\delta_1$ through $\delta_n$;

a detection axis selector for selecting a detection axis $\delta_i$ for each detection instant;

wherein said detection axis selector selects the detection axis $\delta_i$ by determining which axis of said plurality of detection axes $\delta_1$ through $\delta_n$ has a minimal distance E between a point $M_i$ at which the detection axis $\delta_i$ intersects the ground and a point M' at which the projectile strikes the ground.

2. The munition according to claim 1, wherein said plurality of detection axes $\delta_1$ through $\delta_n$ of the target detector are fixed relative to said firing axis $\Delta$.

3. The munition according to claim 1, wherein the detection axis selector comprises a measuring device for determining at any instant which of said plurality of axes $\delta_i$-$\delta_n$ has the forwardmost orientation of the munition in the direction given by a velocity $v_0$ of a center of gravity of the munition.

4. The munition according to claim 3, wherein the measuring device comprises a rangefinder for measuring the distance from the munition to the ground.

5. The munition according to claim 3, wherein the measuring device comprises at least one of a gyroscope and a gyrometer allowing for an angular position of said at least one of a gyroscope or gyrometer to be measured relative to a velocity vector $v_0$.

6. The munition according to claim 1, wherein the detection axis selector is associated with at least one of a gyroscope and gyrometer allowing an angular position of said at least one of a gyroscope and gyrometer to be measured relative to a velocity vector $v_0$ of the center of gravity of the munition with a measuring device measuring the distance to the ground and a measuring device for measuring the instant velocity $v_0$.

7. The munition according to claim 1, wherein the target detector comprises a single sensor including a plurality of detectors.

8. The munition according to claim 1, wherein each of said detection axes $\delta_1$ through $\delta_n$ is located at a periphery of said munition and inclined outwardly at an equal angle relative to said axis firing $\Delta$.

9. The munition according to claim 1, wherein the target detector comprises a single detector associated with a plurality of optical systems having nonparallel axes.

10. The munition according to claim 9, further comprising a blanking cap for illuminating said target detector at each instant t by radiation transmitted by a single optical system with axis $\delta_i$.

* * * * *